United States Patent [19]

Anderson et al.

[11] Patent Number: 4,837,391

[45] Date of Patent: Jun. 6, 1989

[54] DRY ELECTROSTATOGRAPHIC DEVELOPER CONTAINING TONER PARTICLES COMPRISING A VINYL ADDITION POLYMER CONTAINING A COVALENTLY BOUND QUATERNARY PHOSPHONIUM SALT

[75] Inventors: James H. Anderson; Douglas E. Bugner, both of Rochester, N.Y.

[73] Assignee: Eastman Kodak Company, Rochester, N.Y.

[21] Appl. No.: 229,047

[22] Filed: Aug. 5, 1988

[51] Int. Cl.[4] ..... G03G 9/08; G03G 9/10; G03G 9/14

[52] U.S. Cl. ..... 430/110; 430/111; 430/903; 430/904

[58] Field of Search ..... 430/904, 110, 111

[56] References Cited

U.S. PATENT DOCUMENTS

| | | | |
|---|---|---|---|
| 3,985,664 | 10/1976 | Sakaguchi et al. | 430/904 |
| 4,020,192 | 4/1977 | Nozaki | 430/111 |
| 4,224,396 | 9/1980 | Pollet . | |
| 4,299,898 | 11/1981 | Williams et al. . | |
| 4,496,643 | 1/1985 | Wilson et al. . | |
| 4,525,446 | 6/1985 | Uytterhoeven et al. . | |
| 4,537,848 | 7/1985 | Yourd et al. . | |
| 4,547,449 | 10/1985 | Alexandrovich et al. . | |
| 4,606,989 | 8/1986 | Uytterhoeven et al. . | |
| 4,639,403 | 1/1987 | Podszün et al. . | |
| 4,729,925 | 3/1988 | Chen et al. | 430/31 |

*Primary Examiner*—Roland E. Martin
*Assistant Examiner*—Jeffrey A. Lindeman
*Attorney, Agent, or Firm*—David F. Janci

[57] ABSTRACT

New electrostatographic developers are provided, containing dual function polymeric binder/charge agents. The new developers contain toner particles comprising a vinyl addition binder polymer containing a quaternary phosphonium salt, wherein the phosphonium salt has an anionic portion covalently bonded to the binder polymer.

4 Claims, No Drawings

DRY ELECTROSTATOGRAPHIC DEVELOPER CONTAINING TONER PARTICLES COMPRISING A VINYL ADDITION POLYMER CONTAINING A COVALENTLY BOUND QUATERNARY PHOSPHONIUM SALT

FIELD OF THE INVENTION

This invention relates to dry electrostatographic developers comprising carrier particles and toner particles comprising polymeric binders. More particularly, the invention concerns new developers containing toner particles comprising vinyl addition polymers containing certain quaternary phosphonium salts, wherein the anionic portions of the salts are covalently bonded to the polymers. The polymers serve as dual function binder/-charge agents in the toner particles of the inventive electrostatographic developers.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. In order to meet these requirements for proper development, the level of electrostatic charge on the toner particles should be maintained within an adequate range.

Many well-known types of toner particles useful in dry developers comprise vinyl addition polymeric binder materials, chosen for their good combinations of advantageous properties, such as toughness, good adhesion to substrates, and fusing characteristics, such as the ability to be fixed to paper at relatively low fusing temperatures while not permanently adhering to fusing rolls, except at relatively high temperatures. As is well-known, vinyl addition polymers useful as binder materials in toner particles can be linear, branched, or lightly crosslinked and can be fashioned from any of many different monomers, typically by free radical-initiated addition polymerization of monomers containing ethylenic unsaturation.

Also, toner particles in dry developers often contain material referred to as a charge agent or charge-control agent, which helps to establish and maintain toner charge within an acceptable range. Many types of charge-control agents have been used and are described in the published patent literature.

One general type of charge-control agent known to be useful in toner particles for dry developers comprises a quaternary phosphonium salt. A number of such quaternary phosphonium salt chargecontrol agents are described, for example, in U.S. Pat. Nos. 4,496,643 and 4,537,848. Unfortunately, many of those known charge-control agents can exhibit a number of drawbacks in some developers.

For example, some of the known quaternary phosphonium salt charge agents lack thermal stability and, thus, totally or partially decompose during attempts to mix known toner binder materials in well-known processes or preparing toners by mixing addenda with molten toner binders. Such processes are often referred to as melt-blending or melt-compounding processes and are commonly carried out at elevated temperatures. Thus, charge agents that are thermally unstable ata temperatures encountered during melt-compounding can exhibit this decomposition problem.

Also, some of the known quaternary phosphonium salt charge-control agents have relatively high-melting points. During melt-blending, a molten charge agent can be more quickly, efficiently, and uniformly dispersed in the molten toner binder than can a solid charge agent. Non-uniform dispersion can result in poor or inconsistent charge-control performance from toner particle to toner particle (among other undesirable effects discussed below). Therefore, it is a drawback to have a charge agent that will not become molten at the temperatures that will be encountered in melt-compounding, because such a charge agent will be slowly, inefficiently, and non-uniformly dispersed in the toner binder during some melt-blending processes.

Furthermore, some of the known quaternary phosphonium salt charge agents have relatively high electrical conductivity, which can lead to poor performance of some developers.

Also, some known quaternary phosphonium salt charge agents exhibit high sensitivity to changes in environmental relative humidity and/or temperature, which can lead to erratic performance of the charge agents under changing environmental conditions.

Additionally, some of the known quaternary phosphonium salt charge agents will adversely interact chemically and/or physically with other developer or copeier components. For example, some will interact with carrier or carrier coating materials (e.g., fluorohydrocarbon polymer coatings such as poly-(vinylidene fluoride)) and lead to premature carrier aging and shortened useful developer life. Some will interact with certain toner colorants to cause unacceptable hue shifts in the toner. Some will interact with copier fuser rollers (e.g., rollers coated with fluorohydrocarbon polymers such as poly (vinylidene fluoride-co-hexafluoropropylene)) to cause premature failure of the copier's toner fusing system. Some will interact with surface layers of electrostatographic elements to cause poor latent image formation and shortened useful element life.

Also, poor dispersibility of some of the known quaternary ammonium salt charge agents in some of the known vinyl addition polymeric toner binder materials, either because the charge agent remains solid during melt-compounding (as discussed above) or undergoes phase separation from the toner binder when it is attempted to increase its concentration therein, or because it is incompatible with or otherwise poorly dispersible in the binder, can lead to worsening of some of the problems mentioned above. Non-uniform dispersion of charge agent means that higher concentrations of agglomerations of charge agent will exist in some portions of the toner binder mix, compared to others. In typical melt-blending processes, the toner mixture is cooled and ground down to desired particle size after melt-blending. Agglomerations of charge agent provide sites in the mixture where fracture is more likely to occur during grinding. The new surfaces created by such fracture will have a higher concentration of charge agent than will internal sites. Thus, the final toner particles will have a higher surface concentration of charge agent than internal concentration. It should be readily appreciated that if a charge agent tends to adversely interact with the environment, copier components, or other developer components, higher surface concentrations of charge agent on the toner particles will lead to a greater degree of such interaction, thus exacacerbating problems such as high conductivity, high environmental sensitivity, and premature failure of carrier and copier component materials.

Furthermore, in the known dry developers containing known quaternary phosphonium salt charge-control agents in toner particles, the charge-control agents are not chemically bonded to the other toner components, e.g., the polymeric binders. Therefore, the charge-control agents can migrate within, and exude from, the toner particles over time, causing non-uniform dispersion, inconsistent and changing toner charge, and worsening of adverse interactions noted above.

Additionally, with some of the known quaternary phosphonium salt charge-control agents, the changes in charge level produced by relatively slight changes in charge-control agent concentration, can be rather large, such that great precision is required in incorporating the exact amount of charge agent needed to produce a desired level of charge. A very slight deviation from the concentration required in a given toner, may result in a charge level outside of the range considered acceptable for that toner.

It would, therefore, be desirable to provide dry developers containing vinyl addition polymeric toner particles containing quaternary phosphonium salt compositions that perform the charge-controlling function well therein, while avoiding or minimizing all of the drawbacks noted above. The present invention does this.

SUMMARY OF THE INVENTION

The invention provides a dry electrostatographic developer comprising carrier particles and toner particles comprising a vinyl addition polymeric binder and a charge-control agent comprising a quaternary phosphonium salt, wherein the phosphonium salt has an anionic portion which is covalently bonded to the backbone of the binder polymer.

The phosphonium polymers serve as dual function binder/charge-control agents in the toner particles of the inventive electrostatographic developers and have a number of advantages over the non-bonded combinations of vinyl addition polymeric binders and quaternary phosphonium salt charge-control agents described in the prior art.

The phosphonium polymers in the inventive developers have good thermal stability. Neither the polymers as a whole, nor their quaternary phosphonium salt portions will thermally decompose during processes of melt-blending them with other addenda which it may be desirable to include in toner particles (e.g., other binders, colorants, release agents, etc.). They do not exhibit unacceptably high conductivity or environmental sensitivity.

In the toner particles of the inventive developers, the polymers have not been found to interact unacceptably with commonly utilized toner colorants, carrier materials, or copier components such as fuser rolls and electrophotographic elements.

When such a polymer is used as the sole binder/-charge-control agent in a toner particle of a developer of the invention, there is, of course, no problem of lack of compatibility with other binders. When it is desired to additionally include another binder polymer in the toner particle, both polymers can easily be fashioned to provide good compatibility with each other (most easily by choosing some of the recurring units of both polymers to be the same or similar or by choosing recurring units that are already known to provide good compatibility when included in polymers intended to be blended together). Since the quaternary phosphonium salt charge-control moiety is covalently bonded to the polymer, there is no problem of dispersibility, and no such problems have been found to arise when the polymer is mixed with another compatible polymeric binder, in preparing toner particles for some of the developers of the invention.

Also because the salt moiety is covalently bonded to the vinyl addition polymer, there is no migration within, or exuding of the charge-control moiety from, the toner particles of the inventive developer composition.

Furthermore, it has been unexpectedly found that the covalent bonding of the anionic portion of the phosphonium salt to the vinyl addition polymer in developers of the invention provides not only a good charge-control material, but one that is less sensitive to slight changes in its concentration in the toner than the corresponding non-bonded mixtures of polymers and non-polymeric quaternary phosphonium salt charge-control agents in toner particles of the prior art developers or than corresponding vinyl addition polymers wherein the cationic portion of the phosphonium salt is covalently bonded to the polymer. I.e., in toner particles in developers of the invention relatively slight changes in phosphonium salt concentration produce changes in charge level that are not as large. Therefore, less precision is required in incorporating an amount of charge agent adequate to produce a charge level within an acceptable range.

Also, if desired, greater concentrations of the polymer-bound phosphonium salt charge-control moiety can be included in toner particles of the developers of the invention than with the prior art non-polymeric salts, since there is no problem of phase separation at higher concentrations.

It should be noted that other inventive toners and developers containing other phosphonium polymers, are described and claimed in copending U.S. patent applications Ser. Nos. 229,043; 229,045; and 229,046, all filed Aug. 5, 1988.

DESCRIPTION OF PREFERRED EMBODIMENTS

A vinyl addition polymer useful in a toner particle of a developer of this invention comprises any of the recurring units known to be useful in vinyl addition polymeric toner binders in general, with the additional proviso that the polymer contains a quaternary phosphonium salt comprising a cationic portion and an anionic portion, wherein the anionic portion of the salt is covalently bonded to the backbone of the binder polymer.

While the anionic portion of the phosphonium salt is monovalently bonded to the backbone of the vinyl addition polymer in some preferred embodiments, in other embodiments within the scope of the invention it can be divalently bonded to the backbone of the polymer through two covalent linkages.

In all of the embodiments mentioned above the phosphonium polymer has the advantages previously described, apparently because of the covalent bonding of the anionic portion of the phosphonium salt to the backbone of the polymer.

In some preferred embodiments of the inventive developer the phosphonium salt has the structure

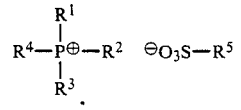

I wherein:

$R^1$ $R^2$, $R^3$, and $R^4$ are each independently: alkyl which is unsubstituted or substituted with one or more aryl; or aryl which is unsubstituted or substituted with one or more alkyl, alkoxy, halo, or haloalkyl;

$R^5$ is directly covalently bonded to the backbone of the binder polymer and comprises arylene, alkylene, or arylenealkylene;

each alkyl, alkoxy, or alkylene moiety recited above has from 1 to 20 carbon atoms; and each aryl or arylene moiety recited above has from 6 to 14 carbon atoms.

In some even more preferred embodiments of the inventive developer, the toner particles comprise a phosphonium vinyl addition polymer, wherein the phosphonium salt is of structure I above, wherein:

$R^1$ is methyl;

$R^2$, $R^3$, and $R^4$ are each phenyl or phenyl substituted with chloro, methyl, methoxy, or trifluoromethyl; and $R^5$ is directly covalently bonded to the backbone of the binder polymer and comprises phenylene.

Such phosphonium vinyl addition polymers can be prepared by any of the known techniques therefor, e.g., free radical-initiated addition copolymerization of any of the ethylenically unsaturated monomers, known to be useful in toner binder polymrs, along with any of such ethylenically unsaturated monomers additionally already having the anionic portion of a quaternary phosphonium salt covalently bonded thereto; or by free radical-initiated addition polymerization of any of the ethylenically unsaturated monomers known to be useful in toner binder polymers, followed by grafting of phosphonium salts onto the polymer. The latter method is preferred, because it offers a better chance of achieving a random distribution of salt moieties in the polymer and the toner particles. Both methods use techniques, well known by those of ordinary skill in this art and described in the published literature. Some specific examples of phosphonium salt-containing monomers useful in the former method are:

methyltriphenylphosphonium styrenesulfonate;

methyltris(4-methoxyphenyl)phosphonium styrenesulfonate;

methyltris(4-methylphenyl)phosphonium styrenesulfonate;

methyltris(4-trifluoromethylphenyl)phosphonium styrenesulfonate; and methyltris(4-chloropheenyl)phosphonium styrenesulfonate;

methyltris(3-trifluoromethylphenyl)phosphonium styrenesulfonate.

Other than the phosphonium salt-containing monomers, other monomers useful in preparing phosphonium polymers for the toner particles of the inventive developer are any of those known to be useful in general to prepare vinyl addition polymeric binders for toner particles. Some examples of such monomers are: monovinyl aromatic compounds such as styrene; the halogenated styrenes such as mono- and dichlorostyrene; the alkylstyrenes such as the methylstyrenes, the ethylstyrenes, the dimethylstyrenes, the diethylstyrenes, the isopropylstyrenes, the mixed alkylstyrenes and the halogenated alkylstyrenes; nuclear-substituted vinyl aryl compounds wherein the nuclear substituent is an alkyl, aryl, alkaryl, aralkyl, cycloalkyl, alkoxy, aryloxy, chloro, fluoro, chloromethyl, fluoromethyl or trifluoromethyl group; the vinylnaphthalenes, methylvinyl naphthalenes and their halogenated derivatives; vinylaryl acids and vinylakyl acids such as acrylic acid, and the alpha-alkyl substituted acrylic acids such as methacrylic acid, and esters of such acids and aliphatic alcohols; the amides of acrylic and methacrylic acids and derivatives thereof such as the methacrylamides, acrylamides, N-methylacrylamides, N,N-diethylacrylamide, N-ethylmethacrylamide, N,N-dimethylmethacrylamide, etc; the nitriles such as acrylonotrile methacrylonitrile, ethylacrylonitrile, chloroacrylonitrile and other nitriles; the alkyl esters of alpha-ethylenic aliphatic dicarboxylic acids such as diethyl fumarate and diethyl itaconate; the unsaturated ketones, methyl vinyl ketone and methyl isopropenyl ketone; the vinylpyridines; the vinylquinolines; vinylfuranes; vinylcarbazoles; the esters of vinyl alcohols such as vinyl acetate; acrylamino substituted acrylic and methacrylic acids; the ethers of olefinic alcohols, especially the ethers of vinyl and allyl type alcohols such as vinyl ethyl ether, vinyl butyl ether, vinyl tolyl ether, divinyl ether, methyl isopropenyl ether, methallyl ethyl ether, the unsaturated aldehydes such as acrolein and methacrolein and the like; copolymerizable alkenyl chlorides including methallyl chloride, allyl chloride, vinyl chloride, vinylidene chloride 1-chloro-1-fluoroethylene and 4-chlorobut-1-ene; the vinylindenes; ethylenic unsaturated monolefins such as ethylene, propylene, butylene and isobutylene; and N-vinyl compounds such as N-vinylpyrole, N-vinyl carbazole, N-vinyl indole and N-vinyl pyrrolidone.

In the preferred method, involving grafting phosphonium salts onto vinyl addition polymers, the appropriate anionic portion of the phosphonium salt is grafted onto the polymer in the form of its sodium salt, which is then converted to the phosphonium salt by ion-exchange with the appropriate quaternary phosphonium halide salt. This is a well known technique.

Further details of preparation of phosphonium polymers for some of the preferred embodiments are included in the Preparations and Examples below.

Preferred phosphonium vinyl addition polymers for use as dual function binder/charge-control agents in preferred electrostatographic developers of the invention are amorphous polymers having a glass transition temperature (referred to as Tg) in the range of about 40° to about 150° C., and more preferably about 50° to about 120° C. Such polymers can be heat-fixed to smooth-surfaced film substrates as well as to more conventional substrates, such as paper, without difficulty. Tg can be determined by any conventional method, e.g., differential scanning calorimetry.

Preferred embodiments contain phosphonium polymers having inherent viscosity in the range of about 0.01 to about 0.65 deciliters per gram (dl/g), as measured at 25° C. and at a concentration of 2.5 g/l in a solution of dichloromethane (DCM), dimethylformamide (DMF), or a 1:1 by weight mix of phenol: chlorobenzene (P:CB).

To perform the charge-control function in an inventive electrostatographic developer, the phosphonium polymer will usually be included in the toner particle in an amount sufficient to yield a concentration of individual phosphonium salt portions of the polymer in the range of about $10^{-9}$ to about $10^{-4}$ moles of phosphonium salt moieties per gram of all material in the toner particles. The exact concentration employed will depend on the level of charge desired and the triboelectric nature of the polymer and all other materials in the toner particle (and also the triboelectric nature of the carrier particles). The phosphonium polymers can also be used as binder/charge-control agents in toner particles intended to be used by themselves (i.e., with no carrier particles) as a so-called "single component" electrostatographic developer.

It should be appreciated that the desired concentration of phosphonium salt moieties in the toner particle can be effected in more than one manner. In cases where the toner particle consists of only the phosphonium polymer, the moles of phosphonium salt moieties per gram of toner particle will be equal to the moles of phosphonium salt-containing units per gram of polymer. In cases where other materials (e.g., other binders, colorants, release agents, etc.) are additionally included in the toner particle, the moles of phosphonium salt-containing units per gram of phosphonium polymer must be higher than the moles of phosphonium salt moieties per gram of toner particle to compensate for the additional weight of other materials in the particle. Thus, phosphonium polymers useful in the inventive developer, include not only those in which phosphonium salt-containing units are included in a concentration range of $10^{-9}$ to $10^{-4}$ moles per gram of polymer, but also others in which the concentration of phosphonium salt-containing units is considerably higher than that range.

As noted above, toner particles useful in the inventive developer can additionally contain other materials, such as other binders, colorants, release agents, etc.

Other binders which can be mixed with the anion-bound phosphonium polymers in inventive developers include any of the polymers known to be useful as toner binders.

Among the various other polymeric binders which can be mixed with the phosphonium polymers in developers of the invention are polyesters (including polycarbonates), polyamides, phenol-formaldehyde polymers, polyesteramides, alkyd resins, and other vinyl addition polymers and copolymers, typically formed from monomers such as styrenes, butadiene, acrylates and methacrylates, among others. For further descriptions of some of these other polymeric binders, see, for example, U.S. Pat. Nos. 3,809,554; Re. 31,072; 3,694,359; 2,917,460; 2,788,288; 2,638,416; 2,618,552; 4,416,965; 4,691,966; and 2,659,670.

Numerous colorant materials selected from dyestuffs or pigments can be employed in toner particles in developers of the invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition.

Included among the vast number of useful colorants are such materials as Hansa Yellow G (C.I. 11680), Nigrosine Spirit soluble (C.I. 50415), Chromogen Black ET00 (C.I. 45170), Solvent Black 3 (C.I. 26150), Fuchsine N (C.I. 42510), C.I. Basic Blue 9 (C.I. 52015). Carbon black also provides a useful colorant. The amount of colorant added may vary over a wide range, for example, from about 1 to about 20 percent of the weight of the polymer. Particularly good results are obtained when the amount is from about 1 to about 10 percent.

To be utilized as a binder/charge-control agent in the toner particles of the inventive electrostatographic developers, the phosphonium polymer is mixed in any convenient manner (preferably by melt-blending as described, for example, in U.S. Pat. Nos. 4,684,596 and 4,394,430) with any other desired addenda, and the mix is then ground to desired size to form a free-flowing powder of toner particles containing the polymer.

Alternatively, the toner components can be solution-blended in a volatile solvent such as dichloromethane and then atomized in a spray-dryer to produce toner particles, as is well known.

Toner particles in developers of the invention usually have an average diameter between about 0.01 μm and about 100 μm, a value in the range from about 1.0 to about 30 μm being preferable for many currently used machines. However, larger or smaller particles may be needed for particular methods of development or development conditions.

To be utilized as toners in electrostatographic developers of the invention, the appropriate toner particles are mixed with a carrier vehicle. The carrier vehicles which can be used to form such inventive developer compositions can be selected from various materials. Such materials include carrier core particles and core particles overcoated with a thin layer of film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618 and 3,898,170 ad Belgian Pat. No. 797,132. Other useful resins are fluorocarbons such as polytetrafluoroethylene, poly(vinylidene fluoride), mixtures of these, and copolymers of vinylidene fluoride and tetrafluoroethylene. See, for example, U.S. Pat. Nos. 4,545,060; 4,478,925; 4,076,857; and 3,970,571. Such polymeric fluorohydrocarbon carrier coatings can serve a number of known purposes. One such purpose can be to aid the inventive developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition of the invention containing toner particles and a carrier vehicle generally comprises from about 1 to about 20 percent by weight of the toner particles and from about 80 to about 99 percent by weight carrier particles. Usually, the carrier particles are larger than the toner particles. Conventional carrier particles have a particle size on the order of from about 2 to about 1200 microns, preferably 5–300 microns.

Alternatively, toners useful in developers of the present invention can be used in a single component developer, i.e., with no carrier particles.

Developer compositions of this invention can be used in a variety of ways to develop electrostatic charge patterns or latent images. Such developable charge patterns can be prepared by a number of means and be carried for example, on a light-sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following preparations and examples are presented to further illustrate the preparation and performance of some preferred embodiments of the developers of the invention and the polymers employed therein and to compare their properties and performance to those of developers outside the scope of the invention.

In some of the preparations and examples below polymer names contain an indication of the molar or weight ratios of the various units in the polymer, as specified. In some preparations and examples (as indicated therein) the relative concentrations of units are expressed as ratios or amounts of the monomers used to prepare the polymer. The shorthand term "tosylate", refers to p-toluenesulfonate.

Where toner charge in a developer is indicated, usually as microcoulombs per gram of toner particles (μc/g), the charge was determined by a technique referred to as the "MECCA" method, wherein the apparatus consists of two parallel metal plates separated by insulating posts about 1 cm high. An AC electromagnet is located beneath the lower plate to provide magnetic agitation, while a DC electric potential of about 2000 volts can be applied across the plates. A sample of about 0.1 gram of developer is weighed, placed on the lower plate, and charged by magnetic agitation for 30 sec. Next, both the electric and magnetic fields are applied for 30 sec. The toner is separated from the carrier by the combined agitation and electric field and is transported to the upper plate by the electric field. The charge on the toner collected by the top plate is measured in microcoulombs by an electrometer, and the weight of toner is determined. The registered charge was divided by the weight of the plated toner to obtain the charge per mass of toner.

PREPARATIONS 1-6

General Procedure for the Preparation of Methyltriarylphosphonium Iodides

The reaction was carried out under dry nitrogen in a 250-mL, round-bottom flask equipped with a magnetic stirrer and reflux condenser. A solution of triarylphosphine and methyl iodide in a 2-butanone (methyl ethyl ketone, MEK, ca. 10 mL/g phosphine) was refluxed for 17 hr. After the reaction had cooled, ether was added, and the precipitate was filtered. It was washed well with ether and then dried in a vacuum oven. All structures were confirmed by NMR.

PREPARATION 1

Methyltriphenylphosphonium iodide

Starting with 10.0 g (38.1 mmol) of triphenylphosphine and 6.8 g (48 mmol, 1.3 eq) of methyl iodide, 14.7 g (36.4 mmol, 95.4%) of methyltriphenylphosphonium iodide was obtained: mp 185.9°-186.8° C.

Anal. found: 56.6% C, 4.4% H, and 7.6% P; Calcd for $C_{19}H_{18}PI$(404.23): 56.5% C, 4.5% H, and 7.7% P.

PREPARATION 2

Methyltris(4-methoxyphenyl)phosphonium iodide

Starting from 10.37 g (34.1 mmol) of tris (4-methylphenyl)phosphine and 6.7 g (48 mmol, 1.4 eq) of methyl iodide, 13.92 g (31.2 mmol, 91.5%) of methyltris(4-methylphenyl)phosphonium iodide was obtained: mp 213°-216° C.

Anal. found 58.9% C, 5.3% H, and 6.4% P; Calcd for $C_{22}H_{24}PI$ (446.31): 59.2% C, 5.4% H, and 6.9% P.

PREPARATION 3

Methyltris(4-methoxyphenyl)phosphonium iodide

Starting from 10.4 g (29.5 mmol) of tris (4-methoxyphenyl) phosphine and 6.7 g (48 mmol, 1.6 eq) of methyl oxide, 13.6 g (27.5 mmol, 93.3% ) of methyltris(4-methoxyphenyl) phosphonium iodide was obtained: mp 220.1°-221.9° C.;

Anal. found 53.5% C, 4.8% H, and 6.5% P; Calcd for $C_{22}H_{24}O_3PI$ (494.31: 53.5% C, 4.9% H, and 6.3% P.

PREPARATION 4

Methyltris(4-chlorophenyl)phosphonium iodide

Starting from 8.28 g (22.6 mmol) of tris (4-chlorophenylphosphine and 5.7 g (40 mmol, 1.8 eq) of methyl iodide, 10.64 g (21.0 mmol, 92.8%) of methyltris (4-chlorophenyl) phosphonium iodide was obtained: mp >250° C.;

Anal. Found: 45.0% C, 3.0% H, 6.1% P, and 20.8% Cl;

Calcd. for $C_{19}H_{15}Cl_3PI$ (507.57): 45.0% C, 3.0% H. 6.1% P, and 21.0% Cl.

PREPARATION 5

Methyltris(3-trifluoromethylphenyl)phosphonium iodide

Starting from 2.39 g (5.13 mmol) of tris(3-trifluoromethylphenyl)phosphine and 1.10 g (7.75 mmol, 1.51 eq) of methyl iodide, 2.57 g (4.23 mmol, 82.4%) of methyltris(3-trifluoromethylphenyl)phosphonium iodide was obtained: mp 225.1°-229.3° C. (dec);

Anal. Found: 43.6% C, 2.6% H, and 5.1% P;

Calcd for $C_{22}H_{15}F_9PI$ (608.22); 43.4% C, 2.6% H, and 5.1% P.

PREPARATION 6

Methyltris(4-trifluoromethylphenyl)phosphonium iodide

Starting from 5.01 g (10.7 mmol) of tris (4-trifluoromethylphenyl)phosphine and 3.22 g (22.7 mmol, 2.11 eq) of methyl iodide, 5.82 g (9.57 mmol, 89.4%) of methyltris(4-trifluoromethylphenyl)-phosphonium iodide was obtained: mp>250°;

Anal. found: 43.8% C, 2.6% H, and 5.0% P;

Calcd. for $C_{22}H_{15}F_9PI$ (608.22): 43.4% C, 2.5% H, and 5.1% P.

PREPARATIONS 7-16

General Procedure for the Direct Quaternization of Methyltriarylphosphines with Methyl Arensulfonates A mixture of the triarylphosphine and an excess of the methyl arenesulfonate were mixed without solvent under an inert atmosphere. The mixture was heated as indicated below, then allowed to cool. The resulting solids were crystallized by treating with ether. The crystals were filtered and were washed well with ether. Analytically pure products were obtained by recrystallization from an appropriate solvent system. All structures were confirmed by NMR, IR and UV-VIS spectroscopy.

PREPARATION 7

Methyltriphenylphosphonium tosylate

A mixture of 11.8 g (45.0 mmol) of triphenylphosphine and 8.40 g (45.1 mmol) of methyl tosylate was allowed to react for 2 hr at 130° C. A total of 19.9 g (44.4 mmol, 98.6%) of methyltriphenylphosphonium tosylate was obtained. This was further purified by stirring overnight in 95:5 ether-acetonitrile. Analyses: mp 147.0°-149.0° C.;

Anal. found: 69.5% C, 5.7% H, 7.0% P, and 7.0% S; Calcd. for $C_{26}H_{25}O_3PS$ (448.52): 69.6% C, 5.6% H, 6.0% P, and 7.1% S.

PREPARATION 8

Methyltriphenylphosphonium 4-methoxybenzenesulfonate

A mixture of 8.89 g (44.0 mmol) of triphenylphosphine and 11.2 g (42.7 mmol) methyl 4-methoxybenzenesulfonate was allowed to react for 2 hr at 140° C. A total of 18.0 g (38.7 mmol, 90.7%) of the title compound was obtained. It was further purified by recrystallization from 90:10 tolueneacetonitrile. Analyses: mp 96.0°-98.5° C.;

Anal. found: 67.1% C, 5.6% H, 6.7% P, and 6.9% S;

Calcd. for $C_{26}H_{25}O_4PS$ (464.52); 67.2% C, 5.4% H, 6.7% P, and 6.9% S.

PREPARATION 9

Methyltriphenylphosphonium benzenesulfonate

A mixture of 19.2 g (73.2 mmol) of triphenylphosphine and 12.6 g (73.2 mmol) of methyl benezenesulfonate was allowed to react for 2 hr at 130° C. A total of 27.6 g (63.5 mmol, 86.8%) of the product was obtained after recrystallization from 75:25 toluene-acetonitrile. Analyses: mp 147.6°-149.7° C.;

Anal. found: 69.2% C, 5.3% H, 7.1% P,and 7.3% S; Calcd. for $C_{25}H_{23}O_3PS$ (434.49): 69.1% C, 5.3% H, 7.1% P, and 7.4% S.

PREPARATION 10

Methyltriphenylphosphonium 4-chlorobenzenesulfonate

A mixture of 11.0 g (41.9 mmol) of triphenylphosphine and 9.16 g (44.4 mmol) of 4-chlorobenzenesulfonate was allowed to react for 2 hr at 140° C. A total of 16.4 g (35.0 mmol, 83.5%) of the title product was obtained. It was further purified by recrystallization from 95:5 toluene-acetonitrile.

Analyses: mp 123.2°-125.2° C.; Anal. found: 63.8% C, 4.9% H, 6.8% P, 7.5: Cl, and 7.0% S;

Calcd. for $C_{25}H_{22}Cl0_3PS$ (468.94): 64.0% C, 4.7% H, 6.6% P, 7.6% Cl, and 6.8 S.

PREPARATION 11

Methyltriphenylphosphonium 4-nitrobenzenesulfonate

A mixture of 5.83 g (22.2 mmol) of triphenylphosphine and 5.00 g (23.0 mmol) methyl 4-nitrobenzenesulfonate was allowed to react for 2 hrs at 145° C. A total of 10.3 g (21.5 mmol, 96.8%) of the product was obtained, which was further purified by recrystallization from 90:10 toluene-acetonitrile.

Analyses: mp 127.0°-128.6° C.; Anal. found: 2.9% N, 62.7% C, 4.7% H, 64.% P, and 6.5% S; calcd. for $C_{25}H_{22}NO_5PS$ (479.49): 2.9% N, 62.6% 4.6% H, 6.5% P, and 6.7% S.

PREPARATION 12

Methyltris(4-methoxyphenyl)phosphonium tosylate

A mixture of 5.37 g (15.2 mmol) of tris (4-methoxyphenyl)phosphine and 2.95 G (15.8 mmol) of methyl tosylate was allowed to react for 1 hr at 135° C. A total of 5.96 g (11.1 mmol, 73.0%) of the product was obtained, which was further purified by recrystallization from 97:3 toluene-ethanol.

Analyses: mp 100.6°-105.4° C.; Anal. found: 64.6% C, 5.8% H, 5.7% P, and 5.8% S; Calcd. for $C_{29}H_{31}0_6PS$ (538.60): 64.7% C, 5.8% H, 5.8% P, and 6.0% S.

PREPARATION 13

Methyltris(4-methylphenyl)phosphonium tosylate

A mixture of 2.38 g (7.82 mmol) of tris(4-methylphenyl)phosphine and 1.53 g (8.22 mmol) of methyl tosylate were allowed to react for 1 hr at 130° C. A total of 2.38 g (4.85 mmol, 62.0%) of product was obtained, which was further purified by recrystallization from 97:3 toluene-ethanol.

Analyses: mp 103.4°-137.1° C.; Anal. found: 69.5% C, 6.3% H, 6.3% P, and 6.6% S; Calcd. for $C_{29}H_{31}0_3PS$ (490.60): 71.0% C, 6.4% H, 6.3% P, and 6.5% S.

PREPARATION 14

Methyltris(4-chlorophenyl)phosphonium tosylate

A mixture of 2.08 g (5.69 mmol) of tris (4-chlorophenyl)phosphine and 1.03 g (5.53 mmol) of methyl tosylate was allowed to react for 1 hr at 125° C. A total of 2.80 g (5.07 mmol, 91.7%) of product was obtained, which was further purified by recrystallization from 97:3 toluene-ethanol.

Analyses: mp 176.5°-177.5° C.; Anal. found: 57.1% C, 4.1% H, 8.4% O, 19.5% Cl, and 5.9% S; calc. for $C_{26}H_{22}Cl_30_3PS$ (551.86): 56.6% C, 4.0% H, 8.7% ), 19.3% Cl, and 5.8% S.

PREPARATION 15

Methyltris(3-trifluoromethylphenyl)phosphonium tosylate

A mixture of 6.20 g (13.3 mmol) of tris(3-trifluoromethylphenyl)phosphine and 2.94 g (15.8 mmol) of methyl tosylate were allowed to react for 3 hr at 140° C. A total of 7.64 g (11.7 mmol, 88.0 %) of product was obtained, which was further purified by recrystallization from toluene-ethanol.

Analyses: mp 176.0°-178.6° C.; Anal. found: 53.2% C, 3.4% H, 5.0% P, 26.5% F, and 5.0% S; Calcd. for $C_{29}H_{22}F_90_3PS$ (652.51): 53.4% C, 3.4% H, 4.7% P, 26.2% F, and 4.9% S.

PREPARATION 16

Methyltris (4-trifluoromethylphenyl)phosphonium tosylate

A mixture of 5.25 g (11.3 mmol) of tris (4-trifluoromethylphenyl)phosphine and 2.43 g (13.0 mmol) of methyl tosylate were allowed to react for 2 hr at 135° C. A total of 5.41 g (8.29 mmol, 73.4%) of product was obtained, which was further purified by recrystallization from toluene-ethanol.

Analyses: mp 185.0°-185.8° C.; Anal. found: 53.5% C, 3.4% H, 4.7% P, 26.6% F, and 5.1% S; calcd. for $C_{29}H_{22}F_90_3PS$ (652.51): 53.4% C, 3.4% H, 4.7% P, 26.2% F, and 4.9% S.

PREPARATION 17-19

General Procedure for the Ion-Exchange Reaction Between Methyltriphenylphosphonium Halide and Sodium Arensulfonates An aqueous solution of a slight excess of the sodium arenesulfonate was added to a well-stirred aqueous solution of methyltriphenylphosphonium halide. The products separated as either a crystalline solid or an oil. They were isolaed and purified as described below. Structures were confirmed by NMR and IR spectroscopy.

PREPARATION 17

Methyltriphenylphosphonium 3-nitrobenzenesulfonate

The reaction was performed starting with 10.0 g (28.0 mmol) of methyltriphenylphosphonium bromide in 150 mL of water and 6.98 g (31.0 mmol, 1.11 eq) of sodium 3-nirobenzenesulfonate in 150 mL of water. The resulting oil was isolated by extracting with dichloromethane (2×50 mL). The organic phase was dried with sodium sulfate then evaporated, yielding 11.9 g (24.8 mmol, 88.6%) of product as a viscous oil.

PREPARATION 18

Methyltripheny;phosphonium 2,4-dinitrobenzenesulfonate

The reaction was performed starting with 10.0 g (28.0 mmol) of methyltriphenylphosphonium bromide in 150 mL water and 8.40 g (31.1 mmol, 1.11 eq) of sodium 2.4-dinitrobenzenesulfonate in 150 mL of water. The resulting solid was filtered, washed with water, and dried to a constant weight in a vacuum oven. A total of 13.26 g (25.3 mmol, 90.3%) of product was obtained, which was further purified by recrystallization from toluene-acetonitrile. Analyses: mp 164.1°-166.9° C.;

Anal. found: 5.3% N, 57.4% C, 4.1% H, 5.9% P, and 5.9% S; calcd. for $C_{25}H_{21}N_2O_7PS$ (524.49): 5.3% N, 57.3% C, 4.0% H, 5.9% P, and 6.1% S.

PREPARATION 19

(Vinylbenzyl)triphenylphosphonium tosylate

To a mixture of 4.15 g (0.01 mol) of m+p) vinylbenzyltriphenylphosphonium chloride in 20 ml of 4:1 $H_2O$ MeOH was added a solution of 1.94 g (0.01 mol) of sodium p-toluene sulfonate in 10 ml of water. The product was isolated and purified. mp=142° C.

anal. calcd. for $C_{34}H_{31}O_3PS$: C, 74.2; H, 5.7; P, 5.6: S, 5.8; Found: C, 73.9; H, 5.6; P, 5.7; S, 5.4.

PREPARATION 20

Styrene homopolymer

Styrene was freed of inhibitor by stirring over basic alumina and then filtering. A solution of styrene (768 g) and azobis (isobutyronitrile) (AIBN) 1.57 g) in toluene (750 mL) was sparged with argon while stirring vigorously for 15 min. The solution was then polymerized under a nitrogen atmosphere at 70° C. for 69 h. It was then cooled and precipitated from methanol in a blender. The filtered precipitate was dried and then reprecipitated from dichloromethane into methanol. The precipitate was washed with additional methanol, then dried in a vacuum oven at 80° C., yielding 430 g of polystyrene; $\overline{M}_n=6.06\times10^4\overline{M}_w=12.5\times10^4$, $\overline{M}_w/\overline{M}_n=2.07$.

PREPARATION 21

Poly(styrene-co-bromostyrene)

(molar ratio 96.7/3.3)

A solution of polystyrene (from Preparation 20) (100 g, 0.960 eq), thallium (III) acetate (0.41 g, 1.1 mmol) in $CCl_4$ (1.45 L) was stirred in the dark for 0.5 hr. Bromine (1.50 mL, 58.5 meq, 5.7 eq%) in $CCl_4$ (22.5 mL) was added, and the solution was stirred in the dark at room temperature for 1 hr, then heated to reflux for 2.0 hr. Upon cooling, it was precipitated from methanol. It was then reprecipitated twice from dichloromethane into methanol and dried in a vacuum oven 63° C., nitrogen purge), resulting 84 g of title product. $M_n=44.26\times10^4$, $M_w=8.38\times10^4$, $M_w/M_n$1.97.

PREPARATION 22

Poly(styrene-co-sryryldiphenylphosphine)

(molar ratio 97.5/2.5)

The preparation of lithium diphenylphosphide was carried out under argon in a 100 mL, 3-necked round-bottom flask equipped with a magnetic stirrer and a rubber septum. To a suspension of 2.32 g (0.334 mol) of lithium wire (cute into ca 6 mm pieces) in dry THF (25 mL; freshly distilled from sodium benzophenone ketyl) were added 8.9 mL (0.060 mol) of chlorodiphenylphosphine via syringe. The flask became slightly warm to the touch, and the lithium turned red-brown. Ater 22 hr at room temperature, the contents of the flask were transferred via cannula into a solution of 80.0 g (24.7 meq) of poly(styrene-co-bromostyrene) (from Preparation 21) in 450 mL dry THF. The viscous, dark brown mixture was stirred for 25 hr and was then precipitated from 2.5 L of methanol in a blender. The dried precipitate was reprecipitated from dichloromethane into methanol and was dried in a vacuum oven (70° C., 65 h), yielding 80.1 g of title product $M_n=4.78\times10^4$, $M_w=25.2\times10^4$, $M_w/M_n=5.28$.

PREPARATIONS 23-28

General Procedure for the Direct Alkylation of

Poly(styrene-costyryldiphenylphosphine

The reaction was carried out under an inert atmosphere in a 250 mL, round-bottom flask equipped with a magnetic stirrer and a reflux condenser. To a solution of 5 g of poly(styrene-co-styryldiphenylphosphine) (from Preparation 22) in 50 mL of solvent was added an excess of methyl arenesulfonate. The reaction mixture was then refluxed for a given length of time, cooled, and precipitated from methanol. The solids were collected and washed extensively with methanol and/or ethanol to remove the excess alkylating agent. The polymer was then dried in a vacuum oven until the remaining volatiles had evaporated. Structures were confirmed by NMR and IR spectroscopy.

PREPARATION 23

Poly(styrene-co-methyldiphenylstyrylphosphonium tosylate) (molar ratio 98.9/1.1)

The alkylation was run in 1:10 ethanol-toluene for 2 hr using 11 eq of methyl tosylate.

PREPARATION 24

Poly(styrene-co-methyldiphenylstyrylphosphonium 4-nitrobenzenesulfonate) (molar ratio 98.8/1.2)

The alkylation was run in toluene for 20 hr using 7.98 eq methyl 4-nitrobenzenesulfonate.

PREPARATION 25

Poly(styrene-co-methyldiphenylstyrylphosphonium 4-CHLORBENZENESULFONATE) (molar ratio 99.5/0.5)

The alkylation was run in dichloromethane for 20 hr using 4.59 eq of methyl 4-chlorobenzenesulfonate.

PREPARATION 26

Poly(styrene-co-methyldiphenylstyrylphosphonium Benzenesulfonate) (molar ratio 99.6/0.4)

The alkylation was run in 1:10 ethanol-toluene for 20 hr using 18.2 eq methyl benzenesulfonate.

PREPARATION 27

Poly(styrene-co-methyldiphenylstyrylphosphonium 4-methoxybenzenesulfonate) (molar ratio 99.4/0.6)

The reaction was run in 1:10 ethanol-toluene for 20 hr using 10.7 eq methyl 4-methoxybenzenesulfonate.

PREPARATION 28

Poly(styrene-co-methyldiphenylstyrylphosphonium iodide) (molar ratio 98.6/1.4)

The reaction was run in 1:10 ethanol-toluene for 18 hr using 20.8 eq of methyl iodide.

PREPARATIONS 29-33

General Procedure for the Ion-Exchange of Poly(styrene-co-methyldiphenylstyrylphosphonium iodide)

A mixture of poly(styrene-co-methyldiphenylstyrylphosphonium iodide) (from Preparation 28) and excess sodium arenesulfonate in 220 mL 10:1 THF-water was refluxed for 22 hr. The solvents were evaporated, and the residue was shredded and washed with 500 mL water in a blender. The solids were filtered and then stirred in warm (45°-50° C.) water (100 mL/g). The filtration and washing were repeated with 1:1 methanol-water and finally with methanol. The product was then dried to a constant weight in a vacuum oven. Structures were confirmed by NMR and IR spectroscopy.

PREPARATION 29

Poly(styrene-co-methyldiphenylstyrylphosphonium tosylate) (molar ratio 99.4/0.6)

The product prepared by this method and displayed $^1H$ NMR and IR spectra identical to those observed for the product prepared by direct quaternization.

PREPARATION 30

Poly(styrene-co-methyldiphenylstyrylphosphonium 4-acetylbenzenesulfonate). (molar ratio 99.1/0.9)

PREPARATION 31

Poly(styrene-co-methyldiphenylstyrylphosphonium 3-nitrobenzenesulfonate). (molar ratio 99.2/0.8)

PREPARATION 32

Poly(styrene-co-methyldiphenylstyrylphosphonium 2,4-dinitrobenzenesulfonate).

PREPARATION 33

Poly(styrene-co-methyldiphenylstyrylphosphonium 4-aminobenzenesulfonate). (molar ration 99.1/0.9)

PREPARATION 34

Poly(styrene-co-sodium styrenesulfonate) (molar ratio 9.9/2.1)

The reaction was carried out under an inert atmosphere in a 3-necked, 1-L, round-bottom flask equipped with a mechanical stirrer and an addition funnel. To a solution of 50.2 g (0.482 eq) of polystyrene (from Preparation 20) in dry dichloromethane (500 mL) was added 1.75 g (0.015 mol, 3.0 eq%) of chlorosulfonic acid (distilled) in dichloromethane (50 mL) over 30 min with vigorous stirring. After 30 min, the reaction was concentrated to ca 250 mL on a rotary evaporator. The concntrate was precipitated from 3.0 L of a solution of NaOH (5% w/v) in methanol. The precipitate was collected and washed with distilled water until neutral (3×2.0 L), and then with 1:1 methanol-water (2×2 L) followed by methanol (2 L). It was then redissolved in THF (500 mL) and treated with a solution of sodium hydroxide (6.3 g) in water (50 mL). The mixture was refluxed 1.5 hr, then precipitated from 1:1 methanol-water (3.0 L). The precipitate was washed and dried as above, yielding 49.8 g of product.

PREPARATIONS 35-39

General Procedure for the Ion-Exchange of Poly(styrene-co-sodium styrenesulfonate)

The reaction was carried out in a 500 mL, round-bottom flask equipped with a magnetic stirrer and a reflux condenser. A mixture of poly(styrene-co-sodium styrenesulfonate) (from Preparation 34) and a ten-fold excess of methyltriarylphosphonium iodide in 250 mL 1:4 water-THF was refluxed for 15 hr. Upon cooling, the solvents were evaporaed, and the residue was shredded in blender with 500 mL of distilled water. The solids were collected, rinsed with water and methanol, and then returned to the reaction flask. An additional 10 eq of methyltriaryl-phosphonium iodide and 250 mL 1:4 water-THF were added, and the mixture was refluxed for 5 hr. The polymer was isolaed as before, then stirred in warm (45°-50° C.) 1:1 methanol-waer (400 mL) for 15 hr, warm water (400 mL) for 4 hr, and finally warm methanol (400 mL) fo 4 hr. The solids were filtered and dried in a vacuum oven (90° C., 20 hr). Structures were confirmed by NMR and IR spectroscopy.

PREPARATION 35

Poly(styrene-co-methyltriphenylphosphonium styrenesulfonate). (molar ratio 97.9/2.1)

PREPARATION 36

Poly[styrene-co-methyltris(4-methoxyphenyl)-phosphonium styrenesulfonate]. (molar ratio 97.8/2.2)

PREPARATION 37

Poly[styrene-co-methyltris(4-methylphenyl)phosphonium Styrenesulfonate]. (molar ratio 97.9/2.1)

PREPARATION 38

Poly[styrene-co-methyltris(4-chlorophenyl)-phosphonium Styrenesulfonate]. (molar ratio 97.8/2.2)

PREPARATION 39

Poly[styrene-co-methyltris(4-trifluoromethylphenyl) phosphonium Styrenesulfonate]. (molar ratio 97.8/2.2)

PREPARATION 40

Poly[(vinylbenzyl)triphenylphosphonium tosylate]

Preparation was by polymerization of (vinylbenzyl)-triphenylphosphonium tosylate in dimethylformamide (DMF) initiated by AIBN, followed by isolation and purification. yield=78%. Inherent viscosity in dichloromethane=0.16 dl/g.

Anal. calcd. for $C_{34}H_{31}O_3PS$: C, 74.2; H, 5.7; C, 8.7; P, 5.6; S, 5.8; Found: C, 73.8; H, 5.7; C, 11.6; P, 5.6; S, 5.8 Structure confirmed by NMR.

PREPARATION 41

Poly[butylstyrene-co-(vinylbenzyl)triphenylphosphonium tosylate](weight ratio 98/2)

Preparation was by copolymerization of 3.69 (0.0067 mol) (vinylbenzyl)triphenylphosphonium tosylate and 52.36 g (0.3267 mol) butylstyrene in DMF, initiated by AIBN, followed by isolation and purification. Yield=35.5 g. Inherent viscosity (DCM)=0.29 dl/g Anal. Calcd. for $C_{1242}H_{1630}O_6P_2S_2$: C, 88.9; H, 9.8; O, 0.6; P, 0.4; S, 0.4; Found: C, 89.0; H, 9.9; O,—; P, 0.3; S, 0.4.

PREPARATION 42

Poly[styrene-co-butyl acrylate-co(vinylbenzyl)triphenylphosphonium tosylate]

Preparation was by aqueous emulsion polymerization of 890.39 g styrene, 318.0 g butyl acrylate, and 36.0 g of (vinylbenzyl)triphenylphosphonium tosylate, followed by precipitation, washing in waer, and drying. Tg=58° C. $\overline{M}_n=8.0\times10^3$; $\overline{M}_w=7.69\times10^5$. Analysis showed 2.9% by weight of the phosphonium recurring unit.

EXAMPLES 1-16

Inventive developers were prepared by combining poly(vinylidene fluoride)-coated strontium ferrite carrier particles with toner particles prepared by spray-drying solutions of polystyrene (from Preparation 20)

mixed with various proportions of the polymers of Preparations 35–39 (i.e., phosphonium vinyl-addition polymers wherein only the anionic portion of the phosphonium salt is covalently bonded to the polymer), in order to yield various concentrations of phosphonium salt moieties in the toner particles. The toner and carrier particles were mixed in a closed container on a two-roll mill for several minutes to form an inventive triboelectrically charged "two-component" dry electrostatographic developer. The polymers of Preparations 35–39 are all poly(styrene-co-methyltris(4-Y-phenyl)phosphonium styrenesulfonates), differing in that Y=H (Prep. 35), Y=methoxy (Prep. 36), Y=methyl (Prep. 37), Y=chloro (Prep. 38), and Y=trifluoromethyl (Prep. 39). For each example the triboelectric charge per mass of toner particles was then measured in microcoulombs per gram of toner (μc/g). Results are presented in Table I. Concentrations of charge agent are expressed as moles of individual phosphonium salt moieties per gram of total material in the toner particles (moles/g).

TABLE I

| Example | Y | Phosphonium salt moiety Concentration in toner (moles/g) | Toner charge (μc/g) |
|---|---|---|---|
| 1 | methoxy | $2.2 \times 10^{-6}$ | 26 |
| 2 | methyl | $2.2 \times 10^{-6}$ | 26 |
| 3 | H | $9.1 \times 10^{-7}$ | 20 |
| 4 | H | $1.1 \times 10^{-6}$ | 20 |
| 5 | H | $2.2 \times 10^{-6}$ | 21 |
| 6 | H | $5.6 \times 10^{-6}$ | 32 |
| 7 | H | $9.1 \times 10^{-6}$ | 36 |
| 8 | H | $1.1 \times 10^{-5}$ | 41 |
| 9 | H | $2.2 \times 10^{-5}$ | 49 |
| 10 | chloro | $7.8 \times 10^{-7}$ | 13 |
| 11 | chloro | $1.1 \times 10^{-6}$ | 13 |
| 12 | chloro | $2.2 \times 10^{-6}$ | 23 |
| 13 | chloro | $5.5 \times 10^{-6}$ | 22 |
| 14 | chloro | $1.1 \times 10^{-5}$ | 14 |
| 15 | chloro | $2.2 \times 10^{-5}$ | 3 |
| 16 | trifluoromethyl | $2.5 \times 10^{-6}$ | 31 |

The results in Table I are discussed after Table III below.

COMPARATIVE EXAMPLES A–X

For comparative purposes non-inventive developers in accordance with the prior art were prepared by combining carrier particles (as in Examples 1–16) with toner particles prepared by spray-drying solutions (in DCM) of polystyrene (from Preparation 20) mixed with various proportions of the non-polymeric quaternary phosphonium salt charge agents of Preparations 7–11 in order to yield various concentrations of phosphonium salt moieties in the toner particles. The charge agents of Preparations 7–11 are all non-polymeric methyltriphenylphosphonium p-X-benzenesulfonates, differing in that X=methyl (Prep. 7), X=methoxy (Prep. 8), X=H (Prep. 9), X=chloro (Prep. 10), and X=nitro (Prep. 11). For each example the triboelectric charge per mass of toner particles was then measured in microcoulombs per gram of toner (μc/g). Results are presented in Table II. Concentrations of charge agent are expressed as moles of individual phosphonium salt moieties per gram of total material in the toner particles (moles/g).

TABLE II

| Comparative Example | X | Phosphonium salt moiety Concentration in toner (moles/g) | Toner charge (μc/g) |
|---|---|---|---|
| A | methyl | $1.1 \times 10^{-6}$ | 10 |
| B | methyl | $1.1 \times 10^{-6}$ | 11 |
| C | methyl | $2.2 \times 10^{-6}$ | 17 |
| D | methyl | $2.2 \times 10^{-6}$ | 18 |
| E | methyl | $5.6 \times 10^{-6}$ | 46 |
| F | methyl | $5.6 \times 10^{-6}$ | 41 |
| G | methyl | $1.1 \times 10^{-5}$ | 67 |
| H | methyl | $4.5 \times 10^{-5}$ | 80 |
| I | methoxy | $5.6 \times 10^{-6}$ | 47 |
| J | methoxy | $4.5 \times 10^{-5}$ | 77 |
| K | H | $5.6 \times 10^{-6}$ | 45 |
| L | H | $4.4 \times 10^{-5}$ | 75 |
| M | chloro | $2.0 \times 10^{-6}$ | 23 |
| N | chloro | $4.4 \times 10^{-6}$ | 35 |
| O | chloro | $5.5 \times 10^{-6}$ | 36 |
| P | chloro | $1.1 \times 10^{-5}$ | 51 |
| Q | chloro | $1.1 \times 10^{-5}$ | 61 |
| R | chloro | $2.2 \times 10^{-5}$ | 71 |
| S | chloro | $2.2 \times 10^{-5}$ | 72 |
| T | chloro | $4.5 \times 10^{-5}$ | 75 |
| U | chloro | $4.4 \times 10^{-5}$ | 74 |
| V | chloro | $1.1 \times 10^{-4}$ | 88 |
| W | nitro | $5.5 \times 10^{-6}$ | 34 |
| X | nitro | $4.5 \times 10^{-5}$ | 73 |

Results in Table II are discussed after Table III below.

COMPARATIVE EXAMPLES A–W

For comparative purposes developers outside the scope of this invention were prepared by combining carrier particles (as in Example 1–16) with toner particles prepared by spray-drying solutions (in dichloromethane, DCM) of polystyrene (from Preparation 20) mixed with various proportions of the polymers of Preparations 23, 24, 25, 26, and 27 (i.e., phosphonium vinyl-addition polymers wherein only the cationic portion of the phosphonium salt is covalently bonded to the polymer) in order to yield various concentrations of phosphonium salt moieties in the toner particles. The polymers of Preparations 23–27 are all poly(styrene-co-methyldiphenylstyrylphosphonium p-J-benzenesulfonates), differing in that J=methyl (Prep. 23), J=nitro (Prep. 24), =chloro (Prep. 25), J=H (prep. 26), and J=methoxy (Prep. 27). For each example the triboelectric charge per mass of toner particles was then measured in microcoulombs per gram of toner (μc/g). Results are presented in Table III. Concentrations of charge agent are expressed as moles of individual phosphonium salt moieties per gram of total material in the toner particles (moles/g).

TABLE III

| Comparative Example | J | Phosphonium salt moiety Concentration in toner (moles/g) | Toner charge (μc/g) |
|---|---|---|---|
| a | methyl | $5.5 \times 10^{-7}$ | 22 |
| b | methyl | $1.1 \times 10^{-6}$ | 46 |
| c | methyl | $1.1 \times 10^{-6}$ | 42 |
| d | methyl | $1.1 \times 10^{-6}$ | 40 |
| e | methyl | $1.7 \times 10^{-6}$ | 65 |
| f | methyl | $2.2 \times 10^{-6}$ | 71 |
| g | methyl | $2.2 \times 10^{-6}$ | 71 |
| h | methyl | $2.2 \times 10^{-6}$ | 77 |
| i | methoxy | $1.1 \times 10^{-6}$ | 35 |
| j | methoxy | $2.2 \times 10^{-6}$ | 67 |
| k | H | $1.1 \times 10^{-6}$ | 36 |
| l | H | $2.2 \times 10^{-6}$ | 70 |
| m | chloro | $5.6 \times 10^{-7}$ | 22 |
| n | chloro | $1.1 \times 10^{-6}$ | 39 |
| o | chloro | $1.1 \times 10^{-6}$ | 32 |

TABLE III-continued

| Comparative Example | J | Phosphonium salt moiety Concentration in toner (moles/g) | Toner charge (μc/g) |
|---|---|---|---|
| p | chloro | $1.1 \times 10^{-6}$ | 39 |
| q | chloro | $1.7 \times 10^{-6}$ | 35 |
| r | chloro | $2.2 \times 10^{-6}$ | 62 |
| s | chloro | $2.2 \times 10^{-6}$ | 56 |
| t | nitro | $1.1 \times 10^{-6}$ | 22 |
| u | nitro | $1.1 \times 10^{-6}$ | 25 |
| v | nitro | $2.2 \times 10^{-6}$ | 48 |
| w | nitro | $2.2 \times 10^{-6}$ | 44 |

A comparison of the results for the corresponding developers in Tables I, II, and III (e.g., compare Examples 3–9 of Table I, Comparative Examples A–H of Table II, and Comparative Examples a–h of Table III) illustrates that the charge agents in the inventive developers of Table I have good charging capability and that changes in their concentration produce smaller changes in charge level than with the charge agents of the developers outside the scope of the invention (Tables II and III). Therefore, in the inventive developers less precision is required in incorporating an amount of charge agent adequate to produce a charge level within a desired range.

The invention has been described in detail with particular reference to certain preferred embodiments thereof, but it should be appreciated that variations and modifications can be effected within the spirit and scope of the invention.

What is claimed is:

1. In a dry electrostatographic developer comprising:

(a) carrier particles and (b) toner particles comprising a vinyl addition binder polymer and a charge-control agent comprising a quaternary phosphonium salt, the improvement wherein the phosphonium salt has an anionic portion which is covalently bonded to the backbone of the binder polymer.

2. The developer of claim 1, wherein the phosphonium salt has the structure

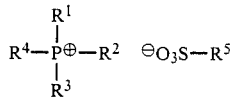

I wherein:

$R^1R_2$, $R_3$, and $R_4$ are each independently: alkyl which is unsubstituted or substituted with one or more aryl; or aryl which is unsubstituted or substituted with one or more alkyl, alkoxy, halo, or haloalkyl;

$R^5$ is directly covalently bonded to the backbone of the binder polymer and comprises arylene, alkylene, or arylenealkylene;

each alkyl, alkoxy, or alkylene moiety recited above has from 1 to 20 carbon atoms; and each aryl or arylene moiety recited above has from 6 to 14 carbon atoms.

3. The developer of claim 2, wherein:

$R^1$ is methyl;

$R^2$, $R^3$, and $R^4$ are each phenyl or phenyl substituted with chloro, methyl, methoxy, or trifluoromethyl; and $R^5$ is phenylene.

4. The developer of claim 1, wherein the toner particles further comprise a second vinyl addition binder polymer.

* * * * *